US006233981B1

(12) United States Patent
Grandpierre

(10) Patent No.: US 6,233,981 B1
(45) Date of Patent: May 22, 2001

(54) WASHING MACHINE EQUIPPED WITH AN AUTOMATICALLY OPENING DRUM DOOR

(75) Inventor: Cyril Grandpierre, Troyes (FR)

(73) Assignee: Electrolux Systemes de Blanchisserie, Rosieres (FR)

( * ) Notice: Subject to any disclaimer, the term of this patent is extended or adjusted under 35 U.S.C. 154(b) by 0 days.

(21) Appl. No.: 09/211,270

(22) Filed: Dec. 14, 1998

(30) Foreign Application Priority Data

Dec. 23, 1997 (FR) ..... 97 16361

(51) Int. Cl.[7] ..... D06F 37/26
(52) U.S. Cl. ..... 68/140; 68/210
(58) Field of Search ..... 68/19, 23.1, 24, 68/140, 210

(56) References Cited

U.S. PATENT DOCUMENTS 3,280,603 10/1966 Schwamm .
3,718,013 * 2/1973 Toth ..... 68/210
3,780,545 * 12/1973 Henderson et al. ..... 68/210
3,896,642 * 7/1975 Toth ..... 68/210
4,479,371 * 10/1984 Fesmire et al. ..... 68/210
5,398,528 * 3/1995 Johnston et al. ..... 68/210
5,437,168 * 8/1995 Mason et al. ..... 68/210
5,438,766 * 8/1995 Nakamura ..... 68/210
5,469,593 * 11/1995 Cuthbert et al. ..... 68/210

FOREIGN PATENT DOCUMENTS

3346427 A1 7/1985 (DE) .
681 048 A2 11/1995 (EP) .
1.263.729 5/1961 (FR) .

* cited by examiner

*Primary Examiner*—Frankie L. Stinson
(74) *Attorney, Agent, or Firm*—Pearne & Gordon LLP

(57) ABSTRACT

In a clothes washing machine loaded and unloaded from the top or the side, the opening of the door (16) of the drum (10) is automatically controlled by an unlocking actuator (38) installed on the external access door (14) or on a retractable support able to take the place of the latter door when it is open. The two leaves **(20*a*, 20*b*) of the drum door (16) are guided, during opening, either by ramps formed on the external access door (14) or on the retractable support, or by an active guidance mechanism installed on the fixed frame (34) in which is installed the external access door (14)**.

21 Claims, 10 Drawing Sheets

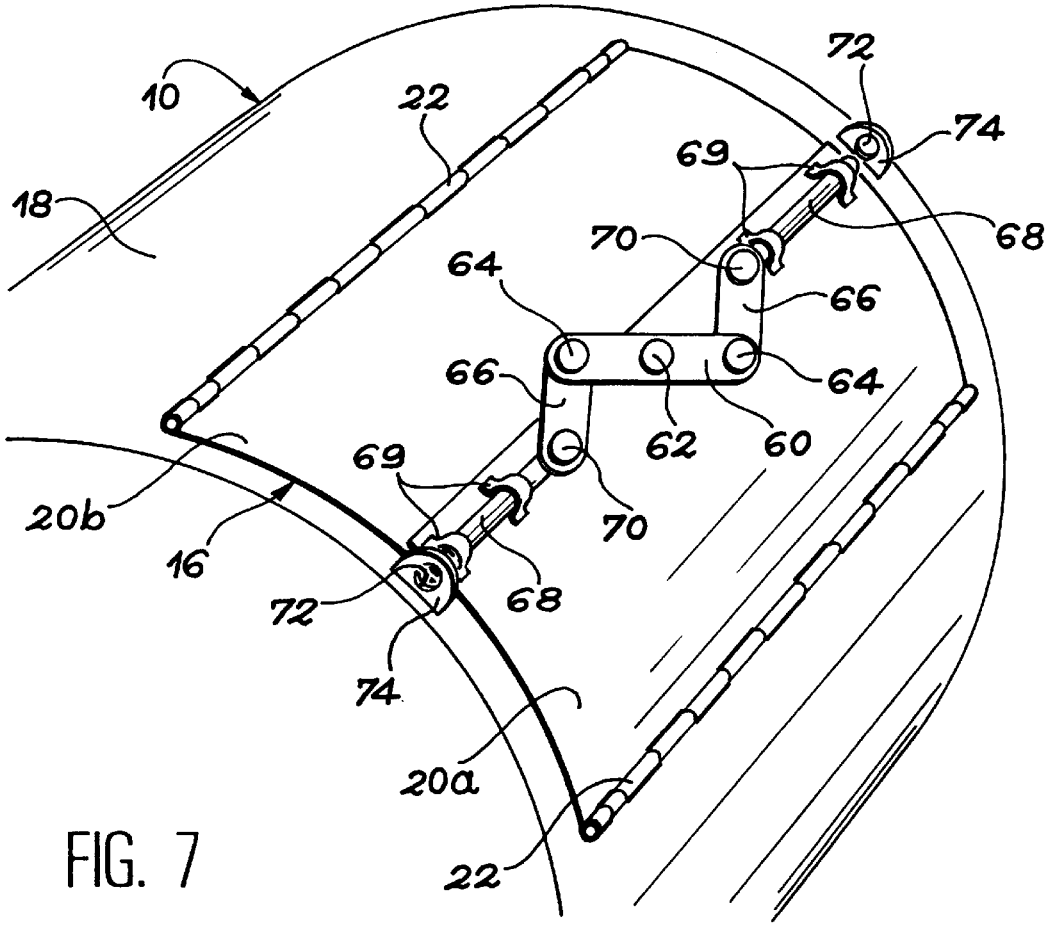
FIG. 7
FIG. 8
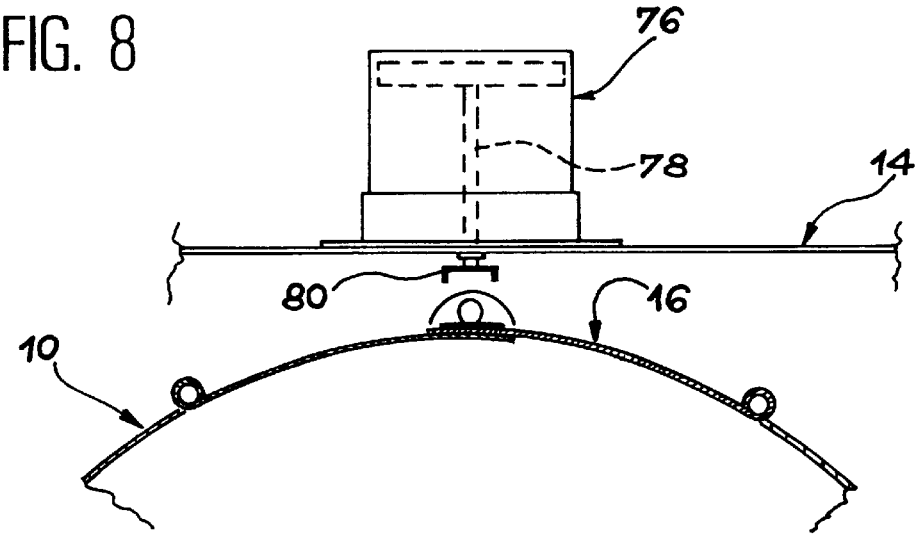

WASHING MACHINE EQUIPPED WITH AN AUTOMATICALLY OPENING DRUM DOOR

BACKGROUND OF THE INVENTION

1. Technical Field

The invention relates to a clothes washing machine of the type in which the washing is received in a drum, which can be rotated about a substantially horizontal axis within a fixed tank or container.

More specifically, the invention relates to a washing machine in which the washing is loaded and unloaded through at least one external access door provided in the fixed tank and at least one drum door located in the circumferential wall of the drum.

Although usable in all washing machines having the aforementioned characteristics, the invention more particularly applies to those having a large or very large capacity, such as those used in commercial establishments. In such washing machines, the interior of the drum is sometimes subdivided into two compartments by a radial partition, access to each compartment being provided by a separate drum door. The tank is then equipped with two external access doors, respectively intended for the loading and unloading of the washing.

2. Description of the Related Art

Compared with washing machines in which the washing is loaded and unloaded by means of a single front door located in the axial extension of the drum, washing machines in which loading and unloading take place from above or the side have the advantage of supporting the drum at its two ends.

However, front loading washing machines have the advantage of giving easy access to the interior of the drum by opening a single door. In the case of machines loaded and unloaded from the top or side, access to the interior of the drum requires the successive opening of the external access door and the drum door.

In washing machines loaded and unloaded from the top or side, the door of the drum conventionally comprises two leaves articulated on the circumferential wall of the drum by two hinges oriented parallel to the axis thereof. Locking and unlocking of the door are ensured by a mechanism interposed between the two leaves and which can be in different forms.

A first, frequently used locking mechanism comprises clips, which project to the outside along the edge of one of the drum door leaves, so as to be able to enter notches formed in the adjacent edge of the other leaf. In order to unlock the mechanism, it is necessary to press a button installed on the leaf carrying the clips, so as to pivot the two door leaves slightly towards the interior of the drum in order to free the clips from the notches. The other door leaf then opens automatically under the action of torsion springs associated with the hinge thereof. The same applies with respect to the leaf carrying the clips, as soon as the button is no longer pressed.

In large and very large capacity washing machines loaded and unloaded from the top or side, equipped with such a drum door locking mechanism, the need to press the leaves in towards the interior of the drum for unlocking the door represents a supplementary disadvantage.

Thus, the weight of the washing processed during each washing-drying cycle is considerable and the peripheral speeds reached by the circumferential door of the drum during the final drying operation are very high. Thus, the washing is subject to a centrifugal force such that it is in the form of a hard "wafer", which is engaged against the cylindrical wall of the drum, when all the washing and drying operations are ended. In view of the fact that the drum door is integrated into the cylindrical wall, the washing wafer is also formed behind said door. Due to the fact that the unlocking of the drum door requires a pressing in of its two leaves, the washing disk formed at the end of the washing-drying cycle constitutes an obstacle making the opening of the door ever more difficult as the capacity of the machine increases.

There are other drum door locking mechanisms, such as link-based mechanisms, slide-based mechanisms and hook-based mechanisms, in which the opening of the door takes place without pressing the leaves into the interior of the drum. However, these mechanisms suffer from other disadvantages such as a more fragile nature, a higher cost, etc. In addition, they do not eliminate the disadvantage common to all washing machines loaded and unloaded from the top or side, which is the necessity to open two doors to obtain access to the interior of the drum.

DESCRIPTION OF THE INVENTION

The invention more specifically relates to a clothes washing machine loaded and unloaded from the top or side, in which access to the drum takes place at least as easily as in a front loaded washing machine, no matter what the drum door locking mechanism, including when the latter is a clip mechanism, whose unlocking makes it necessary to push back the leaves towards the interior of the drum.

According to the invention, this result is obtained by means of a washing machine having a fixed tank and a drum able to rotate within the tank, the tank including at least one access opening defined by a frame and normally sealed by an external access door and the drum including a circumferential wall and at least one drum door located on said wall, so that it can be made to face the external access door by a rotation of the drum, characterized in that the washing machine also comprises means for the automatic opening of the drum door, said automatic opening means including drum door unlocking means installed on a support connected to the tank and constituted by the external access door or by a retractable support, which can be placed in the tank access opening, when the external access door is open.

In the latter case, the retractable support is e.g. articulated on the frame, defining the access opening, so that it can be placed outside the tank when the external access door is closed.

The invention advantageously applies to the case where the d rum door locking mechanism comprises clips and a button fitted on a first of the door leaves and notches formed in the other leaf.

In this case and according to a first embodiment of the invention, the unlocking means incorporate an actuator, provided with a push rod oriented substantially radially with respect to the axis of the drum, in the active position of the support. The push rod is able to press the button installed on the first leaf of the drum door. As a function of the particular case, the actuator is then installed either within the external access door, or outside said door, the latter then being tightly traversed by the push rod.

In a second embodiment of the invention, also applied to the case where the drum door locking mechanism is formed by clips and complimentary notches, the unlocking means incorporate an actuator able to control the rotation of a rotary s haft mounted on the support. The rotary shaft then carries a lever able to press the button installed on the first door leaf.

The invention also applies to the case where the drum door locking m mechanism comprises a pivoting link carried by a first of the door leaves and whose ends cooperate with two pins which slide on said leaf, parallel to the axis of the drum, so as to be able to penetrate holes formed in lugs fixed to the circumferential wall of the drum.

In this case and according to a third embodiment of the invention, the unlocking means incorporate an actuator provided with a rod, which is axially movable and rotatable and which is oriented substantially radially with respect to the drum axis, in the active position of the support. The rod carries at its end a dog able to rotate the pivoting link, after the gripping means has been brought into contact with said link by a translation of the rod.

The invention also applies to a washing machine in which the drum door locking mechanism comprises a slide, which slides on a first of the door leaves, parallel to the drum axis, and locking rivets connected to the other leaf and able to penetrate slots formed in the slide. These slots have narrow portions ensuring locking when the rivets are located therein and widened portions which can be traversed by the rivets in order to permit the pivoting of the door leaves.

In this case, according to a fourth embodiment of the invention, the unlocking means incorporate an actuator able to control the rotation of a rotary shaft mounted on the support, orthogonally to the drum axis. The shaft then carries a lever, which cooperates with an abutment formed on the slide, so as to control the sliding thereof in the unlocking direction.

Finally, the invention also applies to a washing machine, whose drum door is equipped with a locking mechanism incorporating hooks mounted in pivoting manner on a first of the door leaves and interconnected by an articulated control rod, as well as locking rivets connected to the other leaf and with which the hooks can engage.

In this case and according to a fifth embodiment of the invention, the unlocking means incorporate an actuator able to control the rotation of a rotary shaft mounted on the support, orthogonally to the drum axis. The shaft then carries a lever which can engage on an abutment formed on the rod articulated to the hooks.

When the automatic drum door opening means incorporate means for guiding the leaves of said door, said guiding means can comprise ramps carried by the support of the unlocking means, i.e. as a function of the particular case by the external access door or by the retractable support.

When such ramps are provided and when the drum door locking mechanism is a clip mechanism, means for the pre-closing of the first drum door leaf can advantageously be provided. These means are then installed on the frame defining the access opening. They can in particular comprise a second actuator, installed on the outside of the frame and equipped with a push rod tightly traversing the frame, in accordance with a substantially tangential orientation with respect to the drum.

As a variant, instead of being constituted by ramps, the drum door leaf guidance means can be constituted by active means, making it possible to control the opening of the door leaves following the unlocking of the door and to ensure the automatic closure thereof.

More specifically, the means for guiding the leaves then incorporate arms mounted in pivoting manner on the frame defining the access opening, about two axes substantially parallel to the drum axis, and at least one second actuator able to control a controlled pivoting of the arms, in the leaf opening and closing sense. Advantageously, the arms are then fixed to two shafts oriented parallel to the drum shaft articulations.

The two shafts can then be linked in rotation in the reverse sense by a mechanism on which acts a single, second actuator. In the case when the drum door locking mechanism is a clip mechanism, its automatic locking can be brought about by means of a third drum door locking actuator, which is also installed on the tank. This third actuator can be the same as the first actuator ensuring the unlocking of the door.

As a variant, instead of being interconnected by a mechanism, the two shafts carrying the arms ensuring the guidance of the leaves of the drum door can be separately controlled in rotation in the reverse sense by two second actuators.

Finally, it is also possible to provide automatic opening means for the external access door.

BRIEF DESCRIPTION OF THE DRAWINGS

The invention is described in greater detail hereinafter relative to non-limitative embodiments and with reference to the attached drawings, wherein show:

FIG. 7 A perspective view comparable to FIG. 1 showing a drum door equipped with a link locking mechanism.

FIG. 8 A side view, comparable to FIG. 2, illustrating a third embodiment of the automatic opening means according to the invention, applied to the door of FIG. 7.

DETAILED DESCRIPTION OF THE INVENTION

Figure 1:
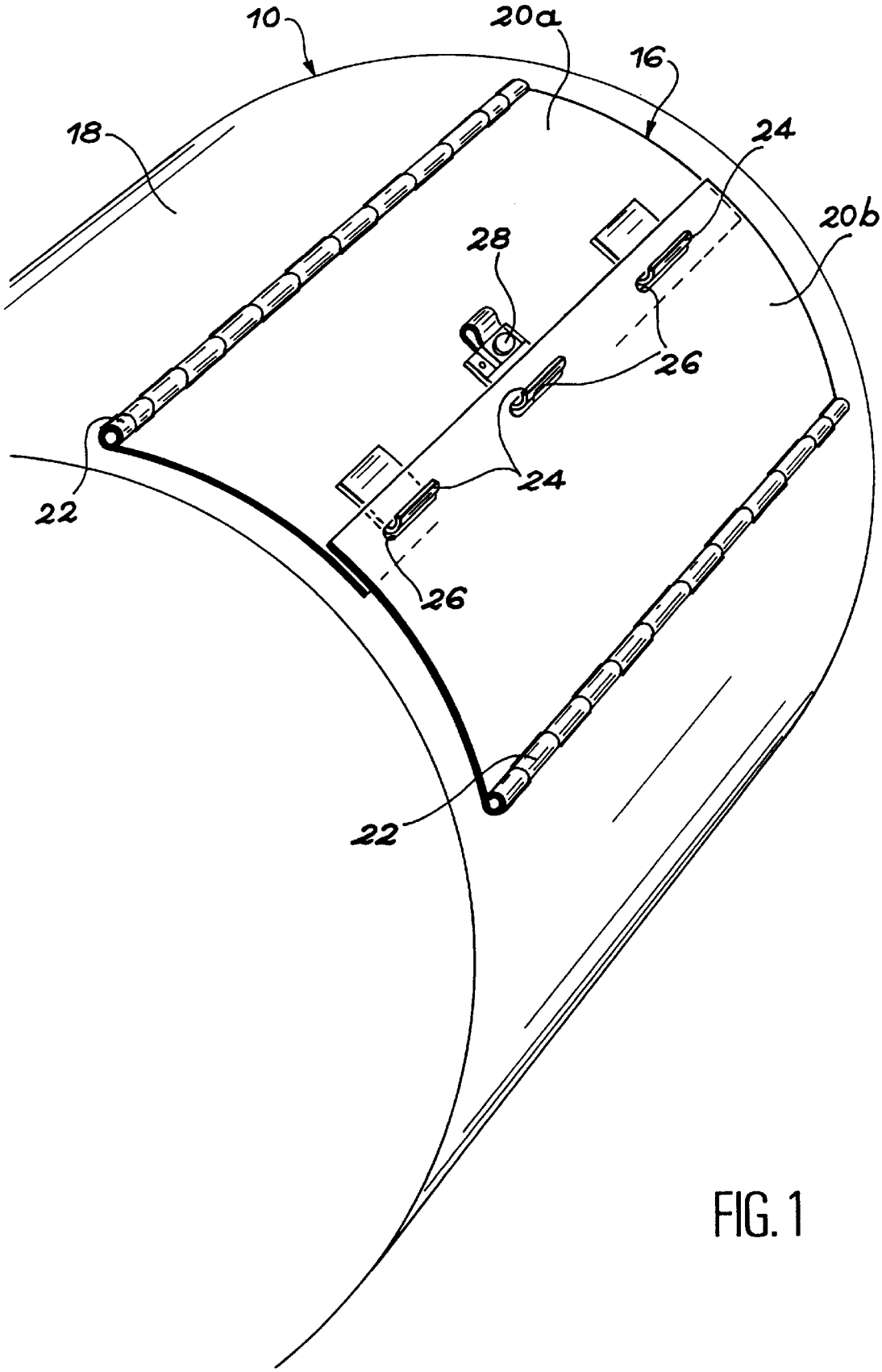
FIG. 1 A perspective view of a washing machine door equipped with a clip locking mechanism.

In FIG. 1, reference numeral 10 designates in general terms a washing machine drum. This drum 10 is installed so as to be able to rotate in one or other direction about a substantially horizontal axis within a fixed tank or container designated in general terms by the reference 12 in FIGS. 3 and 4.

Figure 3:
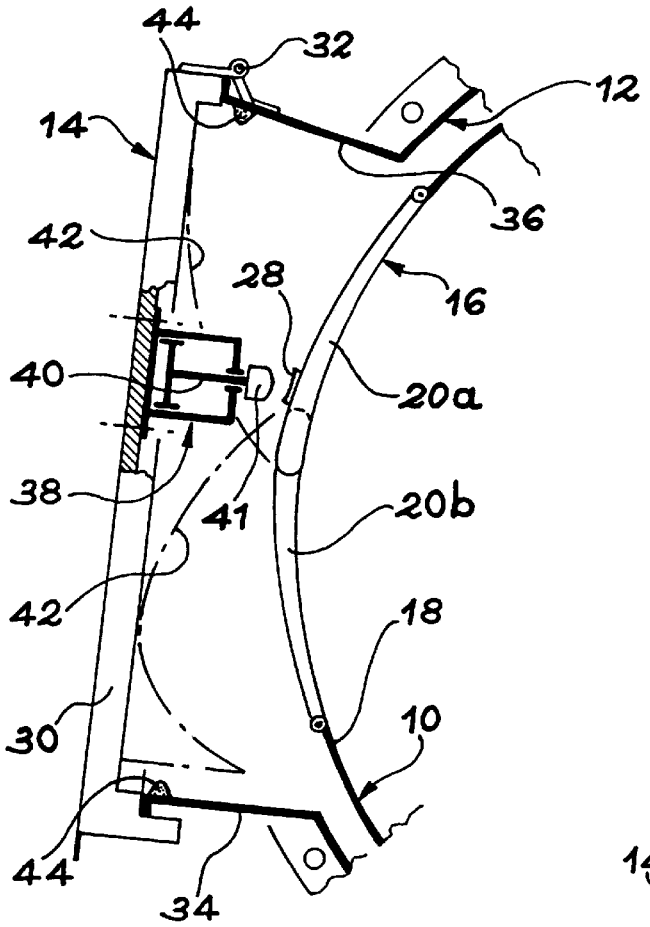
FIG. 3 A side view in diagrammatic section of a first possible installation of the automatic opening means according to FIG. 2.
Figure 4:
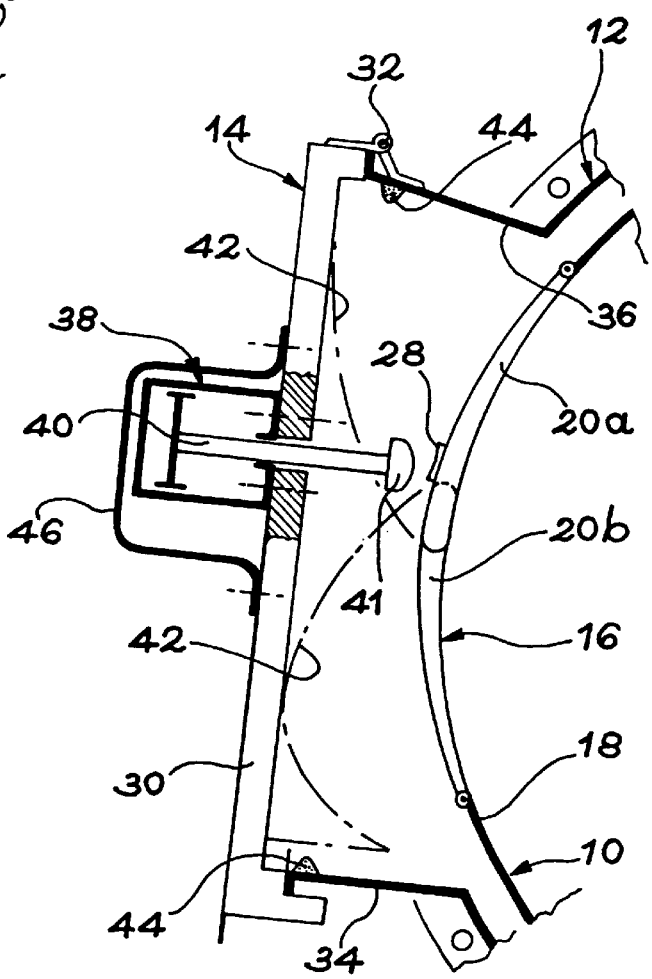
FIG. 4 A side view comparable to FIG. 3, illustrating a second possible installation of the automatic opening means.

As has already been stated on a number of occasions, the invention relates to a washing machine in which the loading and unloading of the washing take place from the top or side. To this end, the fixed tank 12 is equipped, as a function of the particular case, with one or two external access doors 14 (FIGS. 3 and 4). In a comparable manner, as a function of the particular case, the drum 10 has one or two drum doors 16, installed on the circumferential wall 18 of the drum 10.

According to a conventional arrangement and in the manner illustrated in FIGS. 3 and 4, the external access door 14 comprises a single leaf 30 articulated by a hinge 32 on a frame 34, which forms an integral part of the tank 12. This frame 34 internally defines an access opening 36, which is sealed by the door 14 when the latter is in the closed position. An outward pivoting of the leaf 30 of door 14 about hinge 32 makes it possible to free the access opening 36. It is then possible to gain access to the interior of the drum 10 when the drum door 16 faces the access opening 36. In large and very large capacity machines, a not shown indexing system automatically brings the door 16 in front of the access opening 36 at the end of the washing-drying cycle.

As illustrated in FIG. 1, the drum door 16 comprises two leaves 20*a*, 20*b*, articulated on the circumferential wall 18 of the drum 10 by two hinges 22 oriented parallel to the drum axis. Each of the hinges 22 comprises not shown torsion springs, which open the leaves 20*a* and 20*b* of the drum door 16, i.e. pivot the same towards the outside of the drum about the hinges 22. In the open position of the leaves 20*a*, 20*b*, a substantially rectangular access opening in the circumferential wall 18 is freed, which gives access to the interior of the drum 10.

In the embodiment illustrated in FIG. 1, the two leaves 20*a*, 20*b* of the drum door 16 can be maintained in the closed position by a clip-equipped locking mechanism. This conventional mechanism comprises clips 24, fixed to the outer face of the leaf 20*a* in the vicinity of its edge adjacent to the leaf 20*b*. These clips 24 project radially to the outside, so as to be able to penetrate notches 26 formed facing the clips in the leaf 20*b*. The complimentary shapes of the clips 24 and notches 26 are such that the two leaves 20*a*, 20*b* are maintained substantially in the extension of the circumferential wall 18 of the drum, under the action of the torsion springs associated with the hinges 22, when the clips are received in the notches.

Figure 2:
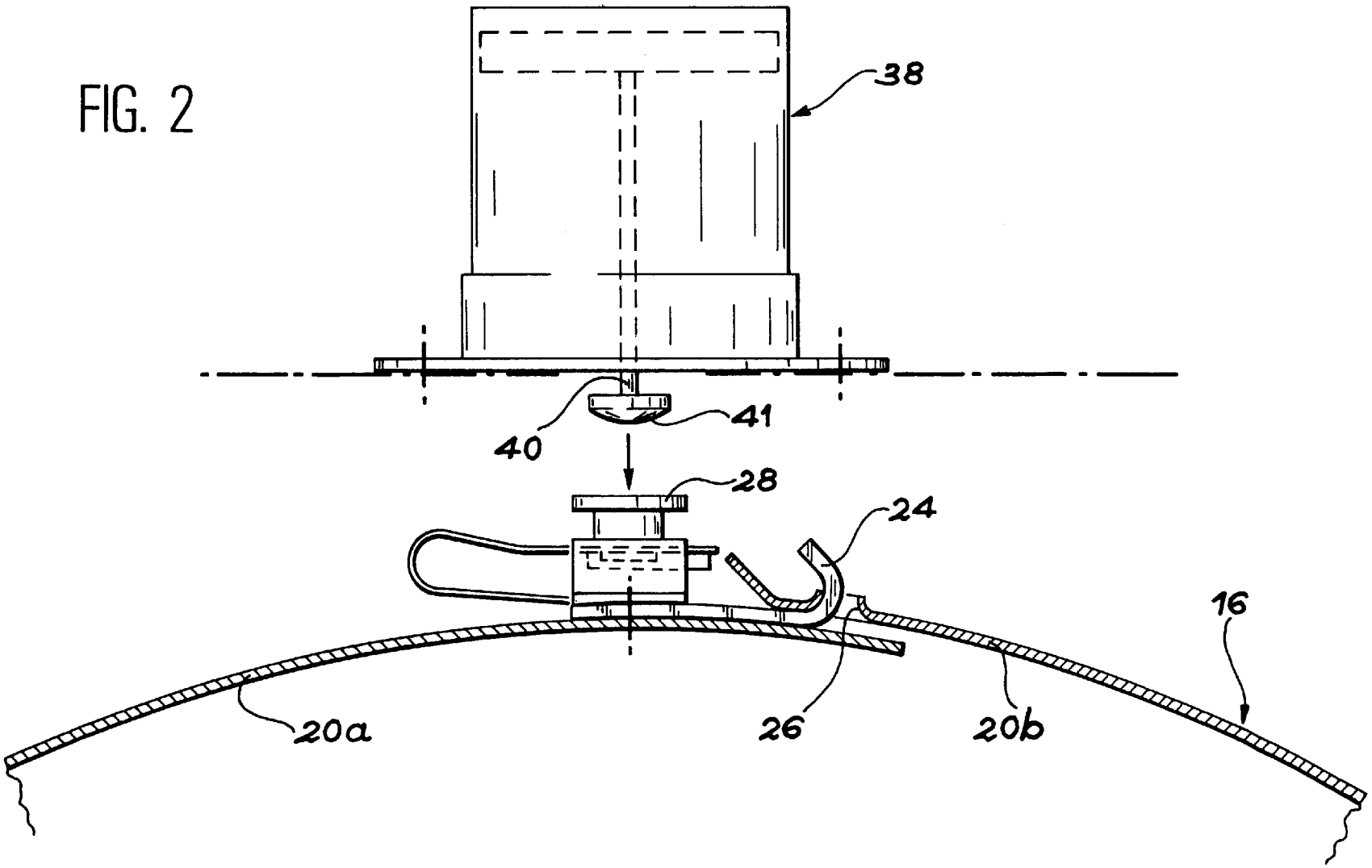
FIG. 2 A side view partly in section of a first embodiment of the automatic opening means according to the invention, applied to the door of FIG. 1.

In addition and as shown in FIG. 2, unlocking can only be obtained by pivoting the leaf 20*a* towards the interior of the drum in order to free the clips 24 from the notches 26. For this purpose a button 28 is installed on the door leaf 20*a*, in the vicinity of the edge of said leaf carrying the clips 24. This conventional arrangement is normally intended to permit the manual unlocking of the door by applying a pressure to the button 28.

According to the invention and as is diagrammatically illustrated in FIG. 2, the washing machine integrates means for the automatic opening of the drum door 16. When the locking mechanism of said door is a clip mechanism, as illustrated in FIGS. 1 and 2, the presence of automatic opening means eliminates the difficulties caused by the presence of a hard washing wafer adhering to the inside of the door and opposing the unlocking of the latter in the case of large and very large capacity machines. Moreover, no matter what type of locking mechanism equips the door 16, the automatic opening means according to the invention give access to the interior of the drum just as easily as on a front loading washing machine.

Figure 16:
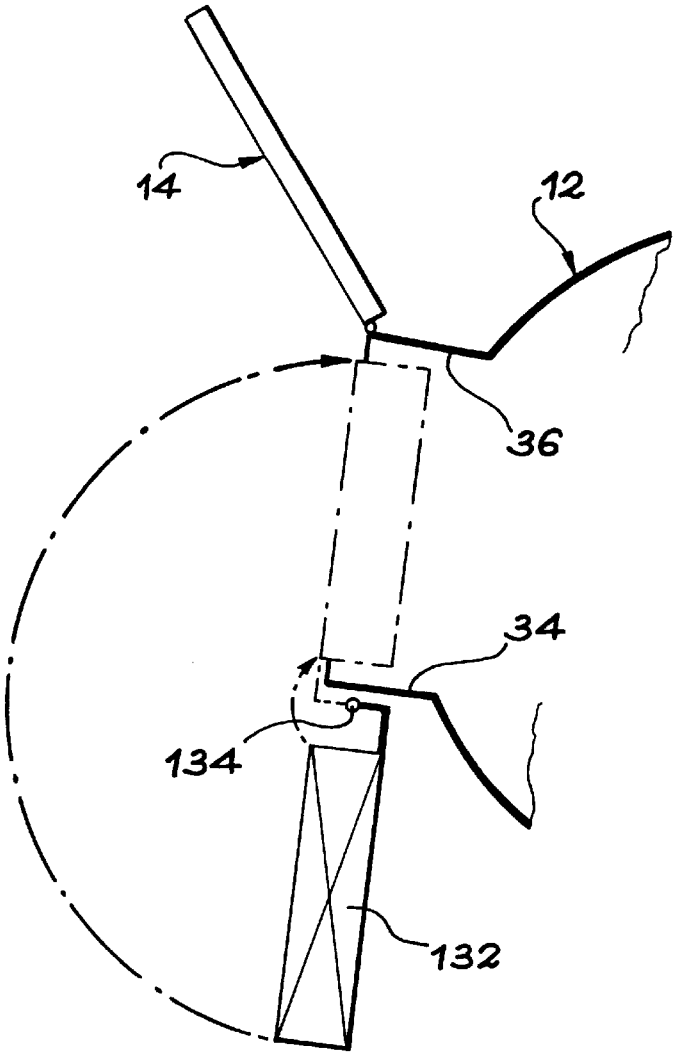
FIG. 16 A side view, in diagrammatic section, representing a pivoting, retractable support on which can be installed the automatic opening means according to the invention.
Figure 17:
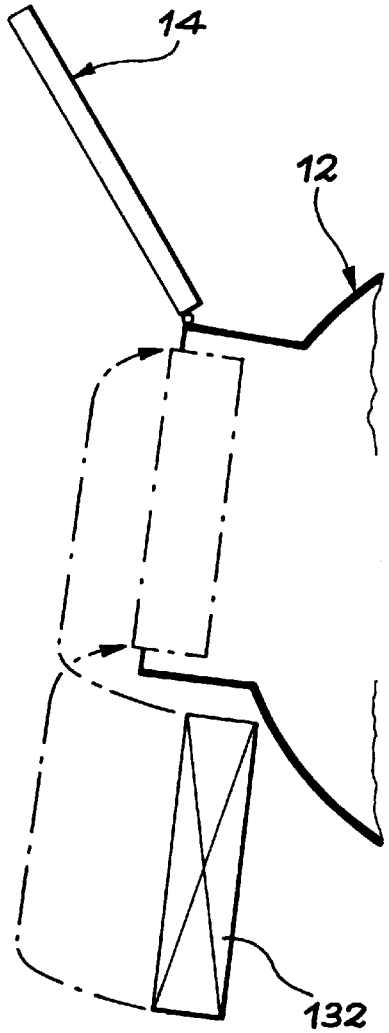
FIG. 17 A view comparable to FIG. 16 illustrating a variant of the installation of the retractable support.

In the first embodiment of the invention diagrammatically illustrated in FIGS. 2 to 4, the means for the automatic opening of the drum door 16 incorporate unlocking means, which include a first actuator 38, e.g. constituted by a double action linear jack. The first actuator 38 is installed either directly on the external access door 14, as illustrated in FIGS. 3 and 4, or on a retractable support 132 which can be brought into the access opening 36 following the opening of said door 14 and as illustrated in FIGS. 16 and 17.

The first actuator 38 is equipped with a push rod 40, whose end is turned towards the interior of the drum and equipped with an end piece 41 able to press the button 28, as illustrated in FIG. 2. For this purpose, the installation of the actuator 38 is such that the axis of the push rod 40 is oriented substantially radially with respect to the axis of the drum 10 when the external access door 14 is closed (FIGS. 3 and 4) or when the retractable support 132 is in the active position (FIGS. 16 and 17). In addition, the fitting of the actuator 38 to the external access door 14 or the retractable support 132 is such that the end piece 41 faces the button 28 when the drum door 16 faces the access opening 36.

As illustrated in FIG. 2, in the inoperative or rest state of the actuator 38, the push rod 40 is almost completely retracted. At the end of the washing-drying cycle, the unlocking of the drum door 16 is controlled automatically. The actuator 38 is then automatically actuated so as to move the push rod 40 in accordance with its axis. The end piece 41 then presses the button 28 over an adequate distance to permit the disconnection of the clip locking mechanism 24. Thus, the unlocking of the drum door 16 takes place automatically and without any problem, even if a hard washing wafer has stuck to the interior of the door under the effect of the centrifugal force applied during drying.

As soon as the clips 24 have been freed from the notches 26, the leaf 20*b* of the drum door 16 is freed and opens automatically under the effect of the torsion springs associated with its hinge 22. The opening of the leaf 20*a* of door 16 takes place as soon as the actuator 38 returns to its inoperative state diagrammatically illustrated in FIG. 2.

To ensure that the opening of each of the leaves 20*b* and 20*b* does not take place too abruptly and in an uncontrolled manner, the automatic opening means according to the invention advantageously incorporate means for guiding the said leaves during their opening.

As is diagrammatically illustrated in mixed line form in FIGS. 3 and 4, these guidance means can in particular be constituted by ramps, provided for this purpose on the internal face of the leaf 30 of the external access door 14 or on the retractable support 132 (FIGS. 16 and 17). These ramps 42 control the opening of the leaves 20*a*, 20*b* of the drum door 16, as the external access door 14 is opened.

At the end of the opening of the external access door 14, each of the leaves 20*a*, 20*b* bears against an elastomer abutment 44 provided for this purpose on the inner surface of the frame 34.

As is diagrammatically illustrated in FIG. 3, the actuator 38 can be installed directly on the face of the leaf 30 of the door 14 turned towards the inside of the washing machine. However, this particularly simple arrangement suffers from the disadvantage of placing all the unlocking means in a hostile, corrosive environment exposed to high temperatures and significant temperature variations. Overall dimensional problems can also arise through the presence of the actuator 38 between the doors 14 and 16.

In the variant illustrated in FIG. 4, the actuator 38 is installed on the outer face of the leaf 30 of door 14. In this case, the push rod 40 tightly traverses the leaf 30. Thus, the actuator 38 is not exposed to the hostile environment prevailing within the tank 12. As is diagrammatically illustrated in FIG. 4, a cap 46 can then be fixed to the outer face of the leaf 30 around actuator 38 in order to ensure the protection thereof.

Figure 5:
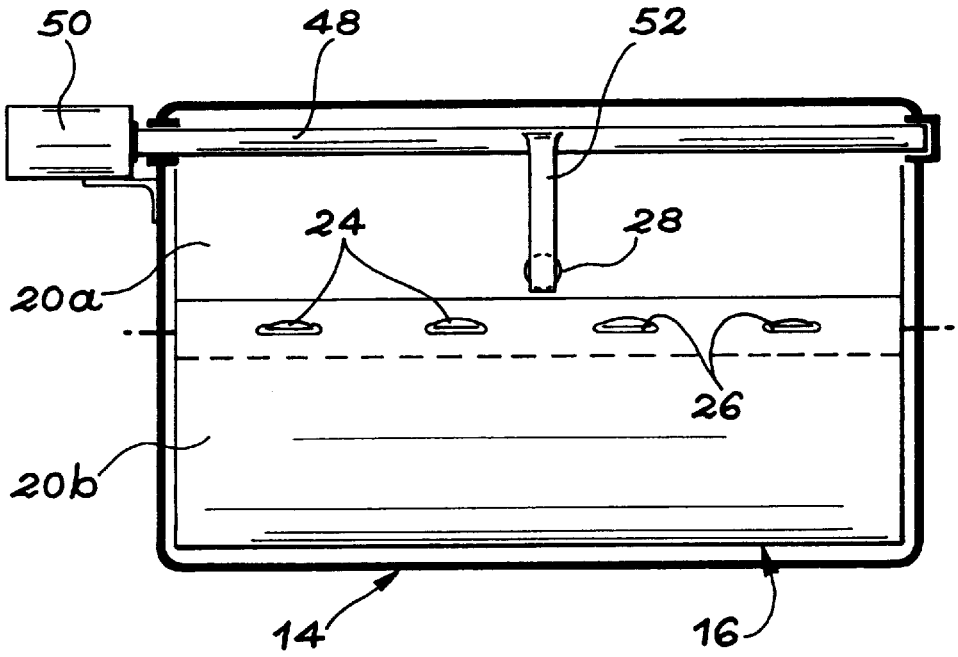
FIG. 5 A plan view, partly in section, diagrammatically showing a second embodiment of the automatic opening means according to the invention, applied to the drum door according to FIG. 1.

FIG. 5 diagrammatically shows a second embodiment of the invention applied to the case of a washing machine, whose drum door 16 is equipped with a clip locking mechanism comparable to that described hereinbefore with reference to FIGS. 1 and 2.

In this second embodiment, the unlocking means are also installed in the external access door 14 and incorporate a rotary shaft 48, supported in rotary manner by the door 14, parallel to the drum axis. At one of its ends, the shaft 48 tightly traverses the door 14, in order to be engaged on an actuator 50 fixed to the door, outside the latter. The actuator 50 is e.g. a rotary motor designed so as to be able to rotate the shaft 48 in one or other direction over a relatively limited path.

In its central portion level with the button 28 carried by the leaf 20*a* of the drum door 16, a lever 52 is fixed to the shaft 48. In the inactive position, the lever 52 is kept supported on a not shown, elastomer abutment provided for this purpose on the inner face of the leaf 30 (FIG. 3) of the external access door 14. This support can optionally be ensured by not shown, elastic means, when the actuator 50 is not in use.

The actuator 50 is automatically put into use at the end of the washing-drying cycle in order to unlock the drum door 16. This has the effect of pivoting the shaft 48 in a direction such that the lever 52 presses the button 28 of leaf 20*a* of door 16. This ensures the unlocking of the clip locking mechanism 24.

Figure 6:
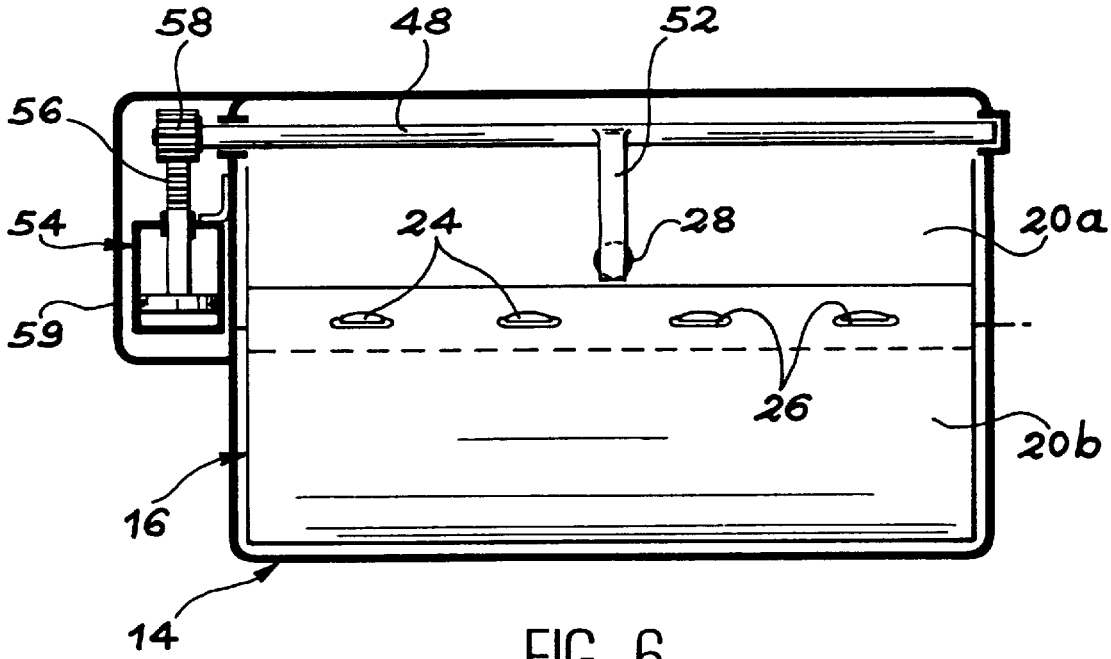
FIG. 6 A view comparable to FIG. 5 showing a variant of the second embodiment of the invention.

As is illustrated as a variant in FIG. 6, the actuator 50 can be replaced by a linear jack 54 installed on the outside of the door 14 and whose rod carries a rack 56. This rack 56 is oriented tangentially to a pinion 58 fixed to the corresponding end of the shaft 48, so as to be engaged on said pinion 58. The assembly is protected by a cover 59.

As has already been stated, the invention also applies to the unlocking of drum doors 16 equipped with locking mechanism differing from the clip mechanism illustrated in FIGS. 1 and 2.

Thus, as is diagrammatically illustrated in FIG. 7, the invention also applies to the unlocking of a drum door 16 equipped with a link locking mechanism. In this case, a central link 60 is articulated by a spindle 62 to the leaf 20*a* of door 16, in the vicinity of its edge adjacent to the leaf 20*b*. More specifically, the spindle 62 is perpendicular to the surface of leaf 20*a* and link 60 is fitted outside said leaf.

Each of the ends of the link 60 is articulated by a spindle 64 to a first end of a link 66. The opposite ends of the links 66 are themselves articulated by another spindle 70 to a first end of a pin 68. The pins 68 are mounted by guides 69 on the leaf 20*a* of the drum door 16, so as to be displaceable in translation in accordance with a common axis parallel to the drum axis. The spindles 64 and 70 are also parallel to the spindle 62.

The link mechanism described hereinbefore is arranged in such a way that a pivoting of the link 60 about spindle 62 displaces the pins 68 in such a way that they move away from or towards one another, as a function of the rotation direction. Therefore the pins 68 can occupy an active locking position or an inactive position, as illustrated in FIG. 7.

In their active locking position, the ends of the pins 68 penetrate holes 72 formed in lugs 74 fixed to the outer surface of the cylindrical wall 18 of drum 10. The opening of the leaves 20*a*, 20*b* under the action of torsion springs integrated into the hinges 22 is then prevented.

However, in their inactive position, the pins 68 are retracted, so that their ends are freed from the holes 72. The leaves 20*a*, 20*b* of the drum door 16 can then pivot freely to the outside under the effect of the torsion springs integrated into the hinges 22.

A third embodiment of the invention adapted to the link locking mechanism of the drum door 16 described in conjunction with FIG. 7, will now be described with reference to FIG. 8.

In this third embodiment of the invention, the unlocking means incorporate an actuator 76. This actuator 76 is installed on the external access door 14 or on the retractable support 132 (FIGS. 16 and 17) and which can take the place of said door when it is open.

The actuator 76 is provided with a rod 78 alignable with the spindle 62 of link 60 at the end of the washing-drying cycle. The putting into action of the actuator 76 then makes it possible to displace the rod 78 in translation and rotation. At its end turned towards the interior of the washing machine, the rod 78 carries a dog 80. Said dog 80 engages on the pivoting link 60 when the rod 78 is displaced axially towards the drum door 16. This engagement is then such that a rotation control of the rod 78 has the effect of rotating the link 60 about its spindle 62 in the unlocking sense.

When unlocking takes place, the rod 78 is again retracted in the interior of the actuator 76, which has the effect of freeing the leaves 20*a*, 20*b* of the drum door 16. The latter are then automatically opened under the action of the torsion springs associated with the hinges 22.

As in the first embodiment described, guidance means are advantageously provided in the external access door 14 or in the retractable support 132 (FIGS. 16 and 17) in order that the opening of the two leaves 20*a*, 20*b* of the drum door takes place progressively during the opening of the external access door 14 or the moving aside of the retractable support 132.

Figure 9:
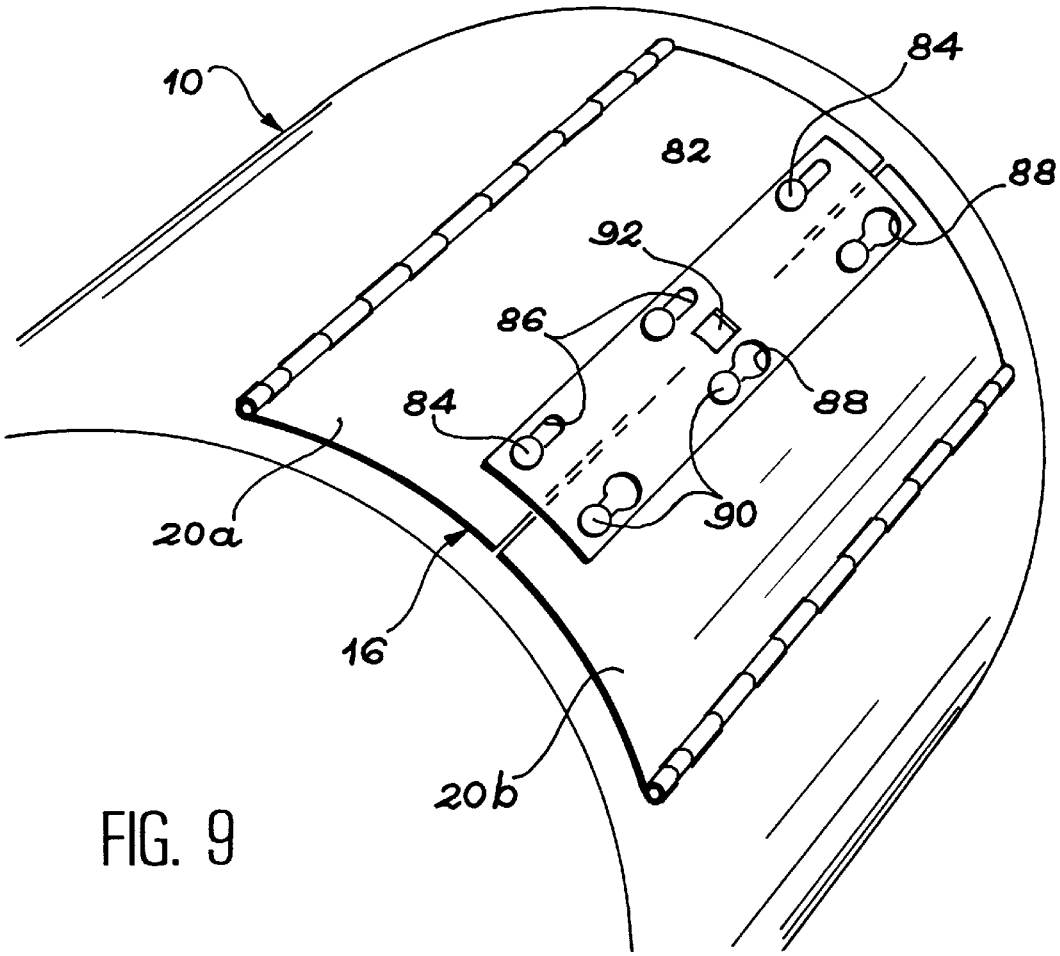
FIG. 9 A perspective view comparable to FIGS. 1 and 7, showing a drum door equipped with a slide locking mechanism.

FIG. 9 illustrates a third type of locking mechanism equipping the drum door 16 of certain washing machines. In this case, the locking mechanism comprises a slide 82 mounted on one 20*a* of the leaves of door 16. More specifically, the slide 82 is installed in the vicinity of the end of leaf 20*a* adjacent to leaf 20*b*, so as to be able to slide parallel to the drum axis between a locking position illustrated in FIG. 9 and an unlocking position. The slide 82 is fitted to the leaf 20*a* by rivets 84 integral with said leaf 20*a* and confined in rectilinear slots 86 formed in the slide 82.

In order to permit locking and unlocking, the slide 82 also has slots 88, in a projecting portion which can be placed above the leaf 20*b*. Each of these slots 88 has a widened portion and a narrower portion. The widened portions of the slots 88 are positioned facing rivets 90 fixed to the leaf 20*b* , when the slide 82 is in its unlocking position. The narrower portions of the slots 88 confine the rivets 90, as illustrated in FIG. 9, in the locking position of slide 82. The displacement of the slide 82 between these two positions is ensured by acting on an abutment 92 projecting to the outside from said slide.

Figure 10:
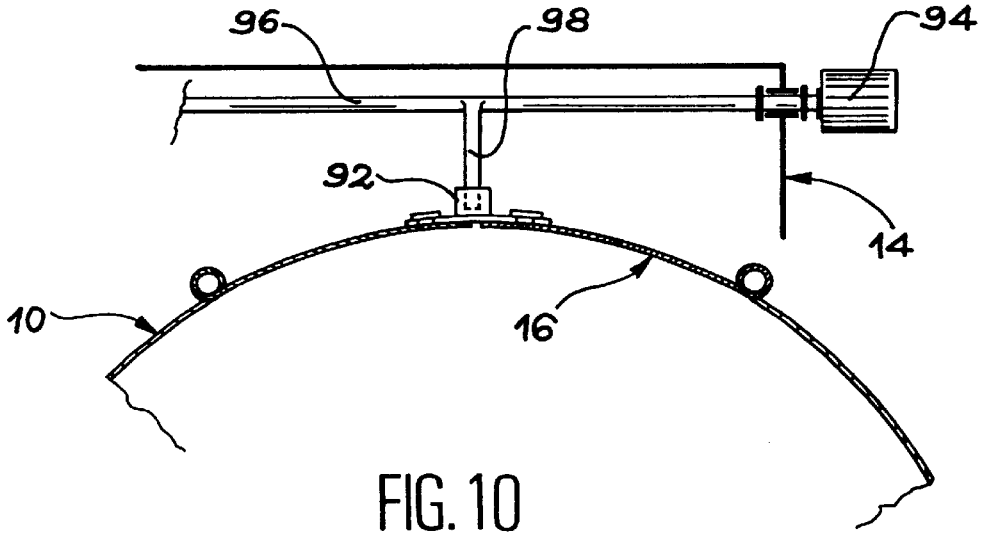
FIG. 10 A side view, comparable to FIGS. 2 and 8, illustrating a fourth embodiment of the automatic opening means according to the invention, applied to the door of FIG. 9.

With reference to FIG. 10 a description will now be given of a fourth embodiment of the invention adapted to the locking mechanism described with reference to FIG. 9.

In this fourth embodiment of the invention, the unlocking means incorporate an actuator 94, installed outside the external access door 14. This actuator 94 controls the rotation of a rotary shaft 96 supported in rotary manner by the door 14, in accordance with a direction orthogonal to the axis of drum 10. A lever 98 is fixed in the central portion of the shaft 96 so as to be able to engage the abutment 92 in the unlocking sense of the locking mechanism of door 16, when the actuator 94 is automatically put into use at the end of the washing-drying cycle.

Figure 11:
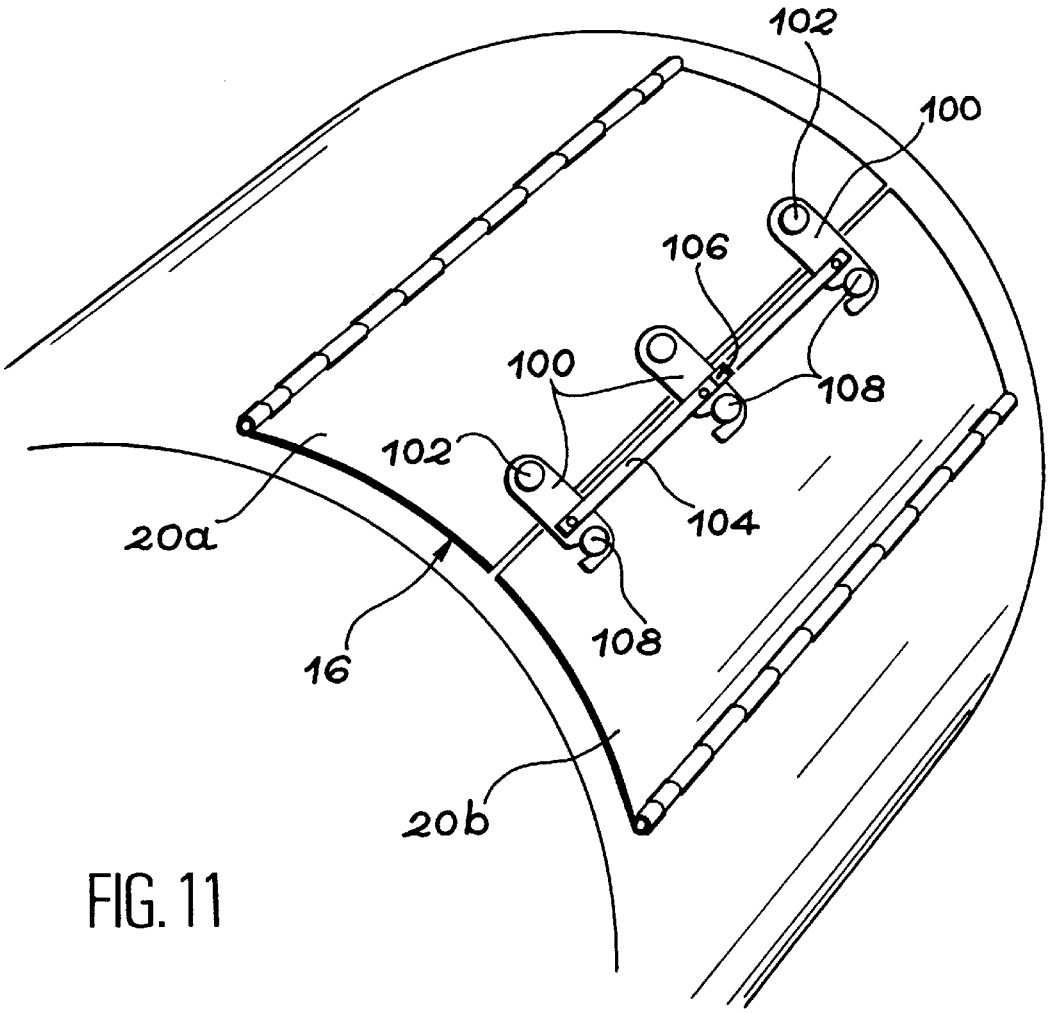
FIG. 11 A perspective view comparable to FIGS. 1, 7 and 9 showing a drum door equipped with a hook locking mechanism.

FIG. 11 shows a hook locking mechanism, which can equip the drum door 16 of a washing machine according to the invention. This type of mechanism comprises hooks 100, fitted so as to pivot on one 20*a* of the leaves of the door 16 by spindles 102 perpendicular to the surface of said leaf. A rod 104 links the hooks 100 by being articulated to each of them. The rod 104 is provided with an abutment 106 permitting the manipulation thereof. Locking rivets 108 are located on the second leaf 20*b* of the door 16 facing the hooks 100. The relative arrangement between the rivets 108 and hooks 100 is such that, when the two door leaves are closed, the door 16 is locked when the ends of the hooks 100 encircle the locking rivets 108. However, the door is unlocked when the ends of the hooks 100 are freed from the locking rivets 108.

Figure 12:
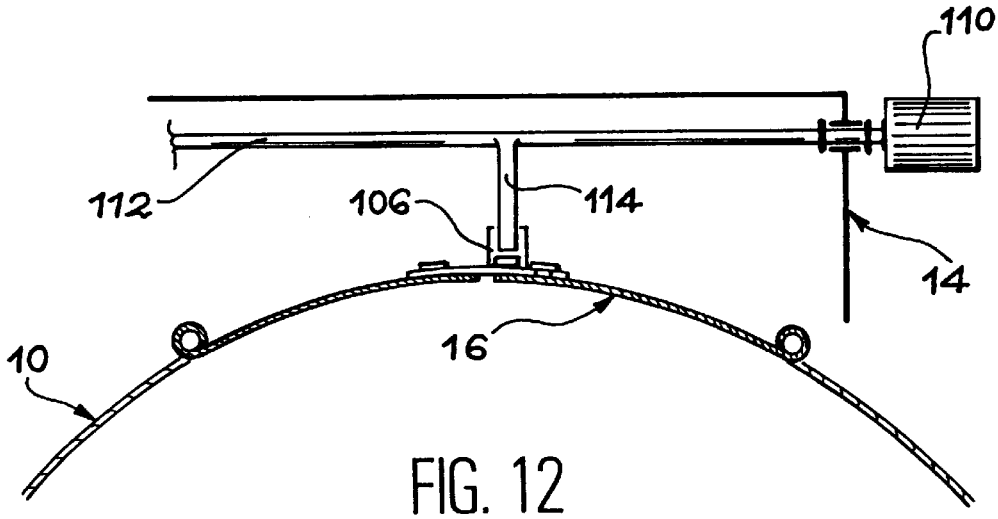
FIG. 12 A side view, comparable to FIGS. 2, 8 and 10, illustrating a fifth embodiment of the automatic opening means according to the invention, applied to the door of FIG. 11.

FIG. 12 diagrammatically shows a fifth embodiment of the invention, adapted to the hook locking mechanism described relative to FIG. 11. In this case, the unlocking means have a structure comparable to that described hereinbefore with reference to FIG. 10, within the scope of the fourth embodiment of the invention. Thus, an actuator 110 installed outside the external access door 14 rotates a shaft 112, supported in rotary manner by the door 14, in a direction substantially orthogonal to that of the axis of drum 10. A lever 114 fixed to the central portion of the shaft 112 is arranged so as to bear against the abutment 106, in order to displace the rod 104 in the mechanism unlocking sense when the actuator 110 is put into use.

The various embodiments described up to now make it possible to control the automatic opening of the drum door 16 with the aid of unlocking means and preferably guidance means installed on a support linked to the washing machine tank (door 14 or retractable support 132).

Figure 13:
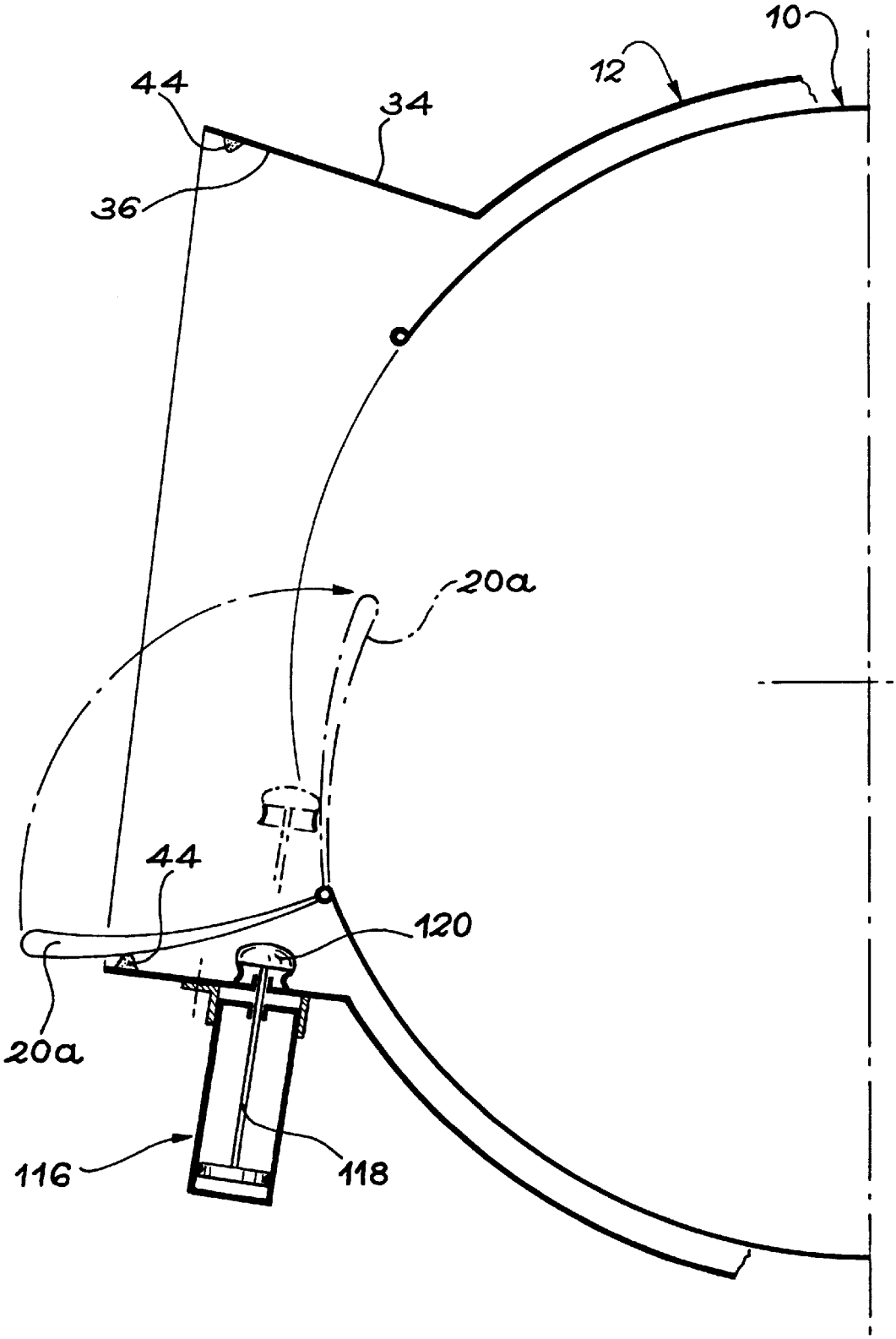
FIG. 13 A side view, in diagrammatic section, illustrating the means for the automatic preclosure of the leaf equipped with the clips of the door of FIG. 1 and which can be associated with any random one of the first three embodiments of the invention.

As is diagrammatically illustrated in FIG. 13, in the case where the locking mechanism of the drum door 16 is a clip mechanism 24, as illustrated in FIG. 1, the door 16 can also be automatically closed following the loading of the washing into the machine. To this end, an actuator 116, here constituted by a linear jack, can be installed outside the frame 34, in order to control the preclosure of the leaf 20*a* of door 16 carrying the clips 24. The actuator 116 is provided with a push rod 118 tightly traversing the frame 34 in a direction substantially tangential to drum 10. Thus, an end piece 120 fixed to the end of the push rod 118 can bear against the leaf 20*a* of door 16, in order to control the preclosure thereof, as is illustrated in mixed line form, when the actuator 116 is put into use.

As shown in mixed line form in FIG. 13, the end piece 120 of push rod 118 is preferably sufficiently wide to bring the leaf 20*a* of door 16 into a retracted position within the drum when the actuator 116 is put into use. It is consequently possible to bring about an automatic locking when the second leaf 20*b* is brought into the closing position by guides 42 (FIG. 3) formed within the door 14, when the latter is closed.

As a variant, locking can be ensured by means of a supplementary, not shown actuator installed on the external access door 14, when the end piece 120 of rod 118 has an inadequate size for bringing the leaf 20*a* into the position illustrated in mixed line form in FIG. 13.

Figure 14:
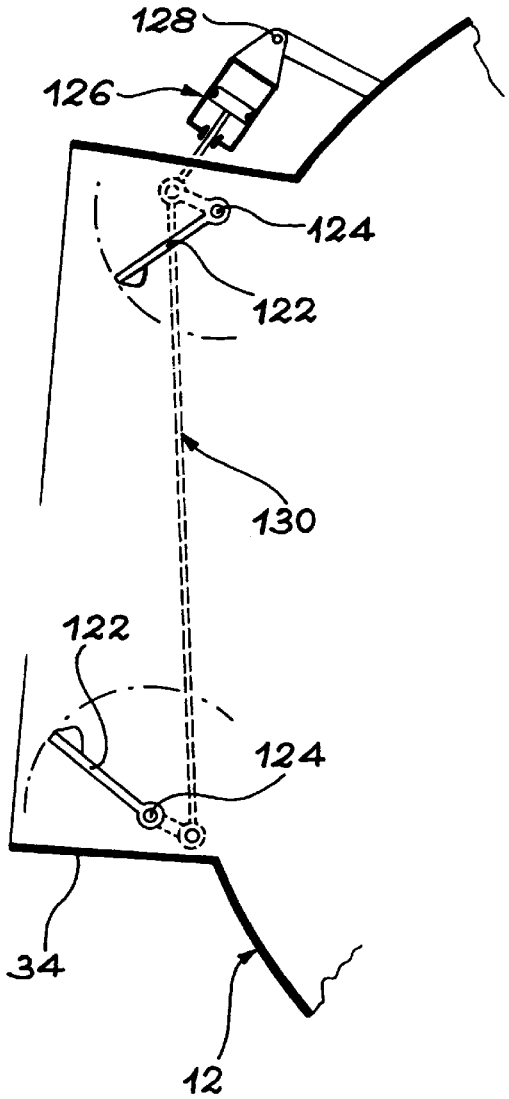
FIG. 14 A diagrammatic sectional view illustrating the active guidance means of the drum door of FIG. 1, which can be associated with any random one of the first three embodiments of the invention, in order to permit the guidance of the door leaves during door opening and for controlling the closing thereof.
Figure 15:
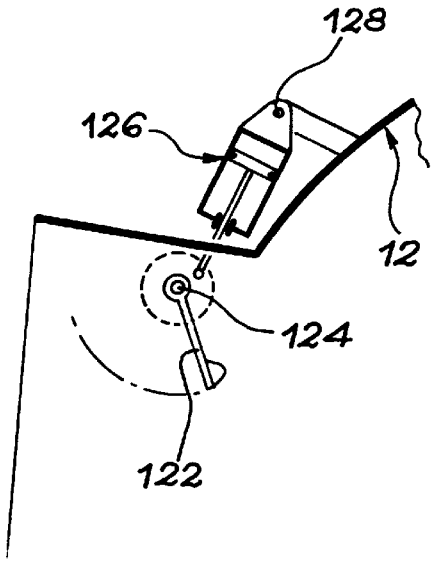
FIG. 15 A sectional view comparable to FIG. 14 illustrating a variant of the active guidance means.
Figure 15:
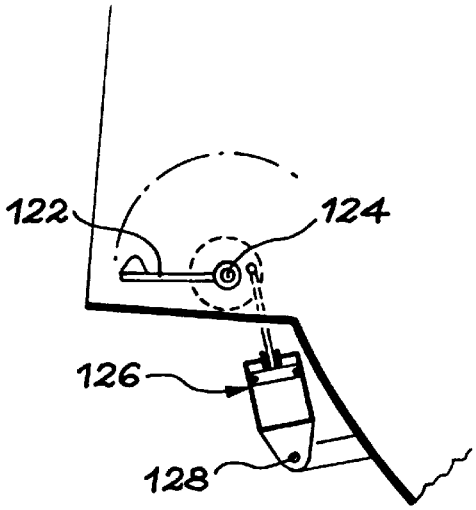

Moreover and as is diagrammatically illustrated in FIGS. 14 and 15, the passive guidance means constituted by the ramps 42 can be replaced by active guidance means for the two leaves of the drum door 16. In this case, said active guidance means can also be used for again closing the drum door and, in the case of FIG. 15, for ensuring the locking thereof.

In the embodiment diagrammatically illustrated in FIG. 14, the guidance means of the leaves 20*a* and 20*b* of drum door 16 incorporate arms 122, which are installed in pivoting manner on frame 34 of tank 12 about two axes oriented parallel to the drum axis. More specifically, these axes are materialized by two shafts 124, to which are fixed the arms 122. The shafts 124 are supported by the frame 34 in the vicinity of its two opposite edges.

In the embodiment of FIG. 14, the reverse pivoting of the shafts 124 is simultaneously controlled by a single actuator 126 installed outside the tank 12. This actuator 126 is here constituted by a jack, whose body is installed in pivoting manner on the tank 12 by a spindle 128 and whose rod controls the reverse rotation of each of the shafts 124 by means of a mechanism 130, e.g. a rod-crank mechanism.

This arrangement does not make it possible to independently control the displacements of the two drum door leaves. Consequently the automatic locking of the drum door equipped with the clip locking mechanism of FIG. 1 assumes the presence of a not shown, further actuator on the external access door. This other actuator then makes it possible to sufficiently embed the leaf 20*b* to ensure that the clips 24 automatically penetrate the notches 26 when said actuator is released.

It should be noted that this supplementary, not shown actuator can be the same as that used for carrying out the unlocking of the door, if said washing machine is equipped with improved indexing means enabling the bringing of the drum into an angular position slightly displaced with respect to the position which it occupies during its opening, when the external access doors are closed.

In the embodiment diagrammatically illustrated in FIG. 15, the need for a supplementary actuator installed on the external access door is eliminated, because each of the arms 122 is controlled by a separate actuator 126.

More specifically, the machine then has two actuators 126, constituted here by jacks, whose bodies are mounted so as to pivot on tank 12 by means of spindles 128. The rod of each of the jacks 126 separately actuates one of the shafts 124 carrying the arms 122 by means of a rod-crank-type mechanism.

As a result of the fact that the two different actuators are used for controlling the arms 122, the displacements of each of the drum door leaves can be independently controlled. Thus, by simply implementing the two actuators 126, it is possible to ensure both the closure of the door leaves and their locking.

As has already been stated, instead of being installed on the external access door 14, the unlocking means and optionally the guidance means can be installed on the retractable support 132, as illustrated in FIGS. 16 and 17.

When the washing machine is operating, the retractable support 132 is placed outside the tank 12, whose external access door 14 then has a conventional configuration.

At the end of the washing-drying cycle, the external access door 14 is open and the retractable support 132 is brought into an active position within the access opening 36, as illustrated in mixed line form in FIGS. 16 and 17. The automatic, drum door opening means can then be used in the manner described hereinbefore.

As has been illustrated in FIG. 16, the retractable support 132 can be articulated on frame 34 by a hinge 134.

FIG. 17 automatically shows an arrangement in which the pivoting installation of the retractable support 132 is replaced by a more complex mechanism, e.g. of the deformable parallelogram type, ensuring a displacement of the support 132 parallel to itself from its inactive, external position to its active position and vice versa.

It should be noted that the automation of the opening of the clothes washing machine according to the invention can be supplemented by the addition of means for the automatic opening of the external access door 14. These not shown, automatic opening means can be constituted by a jack or any equivalent device interposed between the tank 12 and the door 14.

What is claimed is:

1. Washing machine having a fixed tank and a drum able to rotate within the tank, the tank including at least one access opening defined by a frame and normally sealed by an external access door and the drum including a circumferential wall and at least one drum door located on said wall, so that it can be made to face the external access door by a rotation of the drum, characterized in that the washing machine also comprises means for the automatic opening of the drum door, said automatic opening means including drum door unlocking means installed on a support connected to the tank and constituted by the external access door or by a retractable support, which can be placed in the tank access opening, when the external access door is open.

2. Washing machine according to claim 1, wherein the unlocking means are installed on a retractable support articulated to the frame, so as to be positionable outside the tank when the external access door is closed.

3. Washing machine according to claim 1, wherein the unlocking means incorporate an actuator, provided with a push rod oriented substantially radially with respect to the drum axis, in the active position of the support, the push rod being able to press a button installed on a first leaf of the drum door, so as to free clips linked with said leaf from notches formed in a second leaf.

4. Washing machine according to claim 3, wherein the actuator is installed within the external access door.

5. Washing machine according to claim 3, wherein the actuator is installed outside the external access door, the latter being tightly traversed by the push rod.

6. Washing machine according to claims 3 or 5, wherein the automatic opening means also incorporate means for guiding the leaves of the drum door.

7. Washing machine according to claim 6, wherein the means for guiding the leaves incorporate ramps carried by said support.

8. Washing machine according to claim 7, wherein means for preclosing of the first leaf of the drum door are installed on the frame, defining the access opening.

9. Washing machine according to claim 8, wherein the means for the preclosing of the first leaf incorporate a second actuator, installed outside said frame and provided with a push rod tightly traversing the frame, in accordance with an orientation substantially tangential to the drum.

10. Washing machine according to claim 9, wherein a third actuator adapted for locking the drum door is also installed on the support.

11. Washing machine according to claim 6, wherein the means for guiding the leaves of the drum door incorporate arms mounted in pivoting manner on the frame defining the access opening about two axes substantially parallel to-the drum axis and at least one second actuator able to control a controlled pivoting of the arms, in the opening and closing sense of the leaves.

12. Washing machine according to claim 11, wherein the arms are fixed to two shafts oriented parallel to the drum axis.

13. Washing machine according to claim 12, wherein the two shafts are linked in rotation in the reverse sense by a mechanism on which acts a single, second actuator.

14. Washing machine according to claim 12, wherein two second actuators separately control a rotation in the reverse direction of each of the shafts.

15. Washing machine according to claim 1, wherein the unlocking means incorporate an actuator able to control the rotation of a rotary shaft mounted on the support, said shaft carrying a lever able to press a button installed on a first of the leaves of the drum door, in order to free clips linked with said leaf from notches formed in the other leaf.

16. Washing machine according to claim 1, wherein the unlocking means incorporate an actuator equipped with a rod, which is axially mobile and rotatable and which is oriented substantially radially with respect to the drum axis, in the active position of the support, said rod carrying at its end a dog able to rotate a pivoting link carried by a first of the door leaves, so as to free pins linked with said link from holes (72) formed in lugs fixed to the circumferential wall of the drum.

17. Washing machine according to claim 1, wherein the unlocking means incorporate an actuator able to control the rotation of a rotary shaft mounted on the support orthogonally to the drum axis, said shaft carrying a lever which can bear on an abutment formed on a slide installed in sliding manner on a first of the drum door leaves and parallel to the axis thereof, so as to bring widened portions of slots made in the slide in front of locking rivets linked with the other leaf.

18. Washing machine according to claim 1, wherein the unlocking means incorporate an actuator able to control the rotation of a rotary shaft mounted on the support orthogonally to the drum axis, said shaft carrying a lever able to bear on an abutment formed on a rod articulated to hooks mounted in pivoting manner on a first of the drum door leaves, so as to free said hooks from locking rivets linked with the other leaf.

19. Washing machine according to claim 1, wherein the washing machine also comprises means for the automatic opening of the external access door.

20. A washing machine comprising:

a fixed tank including at least one access opening defined by a frame and normally sealed by an external access door;

a drum able to rotate within the tank, said drum including a circumferential wall and at least one drum door located on said wall, said drum door being adapted to face the external access door by a rotation of the drum;

the washing machine further comprising means for the automatic opening of the drum door, said automatic opening means including drum door unlocking means installed on the external access door.

21. A washing machine comprising:

a fixed tank including at least one access opening defined by a frame and normally sealed by an external access door;

a drum able to rotate within the tank, said drum including a circumferential wall and at least one drum door located on said wall, said drum door being adapted to face the external access door by a rotation of the drum;

the washing machine further comprising means for the automatic opening of the drum door, said automatic opening means including drum door unlocking means installed on a retractable support, connected to the tank, said support being adapted to be placed in the tank access opening, when the external access door is opened.

* * * * *